US007140830B2

(12) United States Patent
Berger et al.

(10) Patent No.: US 7,140,830 B2
(45) Date of Patent: Nov. 28, 2006

(54) ELECTRONIC CONTROL SYSTEM FOR SKID STEER LOADER CONTROLS

(75) Inventors: John G. Berger, Landisville, PA (US); John R. Haupt, Lititz, PA (US)

(73) Assignee: CNH America LLC, New Holland, PA (US)

( * ) Notice: Subject to any disclaimer, the term of this patent is extended or adjusted under 35 U.S.C. 154(b) by 1 day.

(21) Appl. No.: 10/341,495

(22) Filed: Jan. 14, 2003

(65) Prior Publication Data

US 2004/0136821 A1 Jul. 15, 2004

(51) Int. Cl.
*E02F 3/00* (2006.01)

(52) U.S. Cl. ..... 414/699; 74/471 XY; 74/478; 180/268; 180/273; 700/213; 701/50

(58) Field of Classification Search ..... 414/699, 414/680, 694, 700; 74/471 XY, 478; 701/50; 700/213; 180/273, 268
See application file for complete search history.

(56) References Cited

U.S. PATENT DOCUMENTS 3,770,919 A * 11/1973 Lewis ..... 180/268
4,856,612 A 8/1989 Clevenger, Jr. et al.
4,871,044 A * 10/1989 Strosser et al. ..... 180/273
5,044,472 A 9/1991 Dammeyer et al.
5,138,756 A * 8/1992 Johnson et al. ..... 414/694 X
5,188,502 A * 2/1993 Tonsor et al. ..... 414/700
5,931,254 A 8/1999 Loraas et al.
6,062,331 A 5/2000 Grunow et al.
6,135,230 A 10/2000 Schenck et al.
6,186,260 B1 2/2001 Schenck et al.
6,202,014 B1 3/2001 Brandt et al.
6,434,437 B1 * 8/2002 Brandt et al. ..... 701/50 X
6,457,545 B1 * 10/2002 Michaud et al. ..... 180/273 X
2001/0007087 A1 7/2001 Brandt et al.
2001/0016794 A1 8/2001 Falck et al.

* cited by examiner

*Primary Examiner*—Donald Underwood
(74) *Attorney, Agent, or Firm*—Stephen A. Bucchianeri; John William Steder; Michael G. Harms

(57) ABSTRACT

An electronic control system for a machine having a boom assembly and an implement assembly. A microprocessor is provided having an input and generating first and second output signals. A first electrohydraulic valve is connected to receive the first output signal from the microprocessor, and connected to position the boom assembly in response to the first output signal. A second electrohydraulic valve is connected to receive the second output signal from the microprocessor, and connected to position the implement assembly in response to the second output signal. A boom position sensor is disposed on the boom assembly or the implement assembly and connected to send a boom position input signal to the microprocessor, the microprocessor being connected to receive the boom position input signal and generate at least one of the first output signal and the second output signal, thereby controlling a position of the implement assembly relative to the boom assembly.

17 Claims, 3 Drawing Sheets

ELECTRONIC CONTROL SYSTEM FOR SKID STEER LOADER CONTROLS

FIELD OF THE INVENTION

This invention pertains to devices or machines having a hydraulic boom and bucket assembly that is operatively controlled by an electronic control system, and to the electronic control system itself. More particularly, the invention relates to a hydraulic boom and bucket assembly, such as would be mounted to a work vehicle or skid steer loader, wherein the hydraulic boom and bucket assembly is operatively controlled by a computer-controlled electronic control system carried by the work vehicle or skid steer loader.

BACKGROUND OF THE INVENTION

Skid steer loaders are work vehicles that include four wheels rotatably mounted to a frame, an engine mounted on the frame and connected by a transmission to rotate at least two wheels, a cab compartment mounted on the frame that includes a seat for an operator, manual controls and a display panel disposed in the cab compartment, a boom assembly rotatably mounted on the frame and connected to a pair of hydraulic boom cylinders for moving the boom assembly, and an implement assembly connected to the boom assembly. Typically, one or more hydraulic cylinders are used to manipulate the implement assembly. Preferably, the implement assembly is a bucket assembly, wherein the implement is a bucket and a pair of hydraulic bucket cylinders is used to move the bucket assembly. Other types of work vehicles that are similar to skid steer loaders include tractors and bulldozers.

To operate the hydraulic boom cylinders and the hydraulic bucket cylinders, an operator in the cab manipulates either hand or foot controls. The skid steer loader, or similar work vehicle, includes an electronic control circuit system that includes an onboard computer, microprocessor, or controller. For the purposes of this disclosure, a computer, microprocessor, or controller are considered to be equivalent and interchangeable elements. The onboard computer operates solenoids of electrohydraulic valves that activate the hydraulic boom and bucket cylinders. To ensure the safe operation of the work vehicle, the electronic control system can be configured to include a safety feature that enables the operation of the electrohydraulic solenoid valves of the hydraulic cylinders only when a safety switch circuit is properly activated. One such electrical circuit forming the controller of a boom solenoid valve is disclosed in U.S. Pat. Nos. 4,856,612 and 4,871,044 to Clevenger, Jr. et al. and to Strrosser et al. respectively, both of which are incorporated herein in their entirely by reference. In the electrical circuit of this controller, there is a built in safety feature wherein the controller cannot operate the boom solenoid valve unless both the belt switch and a seat switch were activated by the simultaneous conditions of (a) having the seat belt restraint mechanism engaged and (b) having an operator sitting in the operator's seat.

U.S. Patent Application Publication U.S. 2001/0007087 A1 to Brandt et al., which is also incorporated herein by reference for all it discloses, teaches a computer based control system for a skid steer loader that includes a computer receiving inputs from a control panel, various sensors, hand grip and foot pedal inputs, and a seat bar sensor. The computer generates outputs to hydraulic actuators and associated valves, and to electromechanical devices.

The prior work vehicles have several drawbacks. First, it is desirable to permit an operator to select enablement of either hand or foot controls for manipulating the boom assembly and the bucket assembly. In addition, because the boom assembly and the bucket assembly are manually controlled separately, the operator can mistakenly dump out the contents of the bucket inadvertently. In some cases, such as when operating a fork lift, it may be an advantage to manipulate the boom assembly while maintaining a constant angular bucket position (i.e. horizontal) of a fork lift work implement to the ground or to the work vehicle. Therefore, it would be beneficial to provide an electronic control system for a work vehicle that includes a multi-mode self-leveling bucket option for maintaining a constant angular bucket position of the bucket to the ground, to the work vehicle, or to some returnable position of advantage.

The present invention endeavors to provide an improved electronic control system for a work vehicle, or like machine, having a boom assembly and a work implement assembly connected to the boom assembly so that the improved electronic control system of the present invention maintains the benefits of the prior electronic control systems while overcoming the drawbacks of these prior control systems.

Accordingly, one object of the present invention is to overcome the disadvantages of the prior art electronic control systems for work vehicles and like machines.

Another object of the present invention is to provide an electronic control system for work vehicles, and like machines, that includes a safety switch to prevent enablement of the solenoids of the boom assembly and the bucket assembly unless an operator is sitting in the operator's seat and/or the seat belt restraint device has been properly secured.

Another object of the present invention is to provide an electronic control system for work vehicles, and like machines, that includes a multi-mode self-leveling bucket option for maintaining a constant angular bucket position of the bucket to the ground, to the work vehicle, or to some desired retrievable position of advantage.

Another object of the present invention is to provide an electronic control system for work vehicles, and like machines, that permits the selection and enablement of either hand or foot controls to manipulate the boom assembly and the implement assembly.

Another object of the present invention is to provide an electronic control system for work vehicles, and like machines, that is practical and cost effective to manufacture.

Another object of the present invention is to provide an electronic control system for work vehicles, and like machines, that is both durable and reliable.

Of course, while the electronic control system for work vehicles, and like machines, will be described for use in skid steer loaders and like machines, another object of the present invention is to provide an electronic control system for a machine having a boom assembly and an implement assembly connected to the boom assembly, wherein the machine can be a self-propelled machine or a stationary machine.

SUMMARY OF THE INVENTION

In accordance with the above objectives, the present invention provides a first preferred embodiment that is an electronic control system for a machine having a boom assembly and an implement assembly connected to the boom assembly, the control system comprising: (a) a microprocessor having an input and generating first and second output signals; (b) a first electrohydraulic valve connected to receive the first output signal from the microprocessor, wherein the first electrohydraulic valve is connected to position the boom assembly in response to the first output signal; (c) a second electrohydraulic valve connected to receive the second output signal from the microprocessor, wherein the second electrohydraulic valve is connected to position the implement assembly in response to the second output signal; and (d) a boom position sensor disposed on the boom assembly or the implement assembly and connected to send a boom position input signal to the microprocessor, wherein the microprocessor is connected to receive the boom position input signal and generate at least one of the first output signal and the second output signal, thereby controlling a position of the implement assembly relative to the boom assembly.

In accordance with a second preferred embodiment, the first preferred embodiment is modified to include a safety switch circuit connected to send a first activation signal to the microprocessor, wherein the microprocessor is unable to generate the first output signal and is unable to generate the second output signal until the microprocessor receives the first activation signal generated by the safety switch circuit.

In accordance with a third preferred embodiment, the second preferred embodiment is further modified so that the safety switch circuit includes a seat belt having male and female ends so that the safety switch circuit sends the first activation signal when the male and female ends are secured together.

In accordance with a fourth preferred embodiment, the second preferred embodiment is further modified so that the safety switch circuit is connected to an operator's seat so that the safety switch circuit sends the first activation signal when an operator is sitting in the operator's seat.

In accordance with a fifth preferred embodiment, the second preferred embodiment is further modified so that the safety switch circuit includes a seat belt having male and female ends and the safety switch circuit is connected to an operator's seat so that the safety switch circuit sends the first activation signal when the male and female ends of the seat belt are secured together and an operator is sitting in the operator's seat.

In accordance with a sixth preferred embodiment, the first preferred embodiment is further modified so that the implement assembly is selected from the group consisting of a pallet forks lift assembly and a loader bucket assembly.

In accordance with a seventh preferred embodiment, the first preferred embodiment is further modified to include a right hand stick implement control sensor disposed to sense a position of a right hand control; a left hand stick boom control sensor disposed to sense a position of a left hand control; a right foot pedal implement control sensor disposed to sense a position of a right foot pedal control; and a left foot pedal boom control sensor disposed to sense a position of a left foot pedal control, where each control sensor is connected to send electronic signals to the microprocessor.

In accordance with an eighth preferred embodiment, the seventh preferred embodiment is further modified to include a hand/foot controls selector switch connected to send a first enabling signal to the microprocessor, wherein the first enabling signal enables the microprocessor to generate first and second output signals in response to electronic signals received from the right hand stick implement control sensor and the left hand stick boom control sensor, and electronic signals received from the right foot pedal implement control sensor and the left foot pedal boom control sensor have no effect on the first and second output signals generated by the microprocessor.

In accordance with a ninth preferred embodiment, the eight preferred embodiment is further modified so that the microprocessor uses electronic signals received from the right hand stick implement control sensor to generate the second output signal and electronic signals received from the left hand stick boom control sensor to generate the first output signal.

In accordance with a tenth preferred embodiment, the eighth preferred embodiment is further modified so that the hand/foot controls selector switch is connected to send a second enabling signal to the microprocessor, wherein the second enabling signal enables the microprocessor to generate first and second output signals in response to electronic signals received from the right foot pedal implement control sensor and the left foot pedal boom control sensor, and electronic signals received from the right hand stick implement control sensor and the left hand stick boom control sensor have no effect on the first and second output signals generated by the microprocessor.

In accordance with an eleventh preferred embodiment, the seventh preferred embodiment is further modified to include a hand/foot controls selector switch connected to send a first enabling signal to the microprocessor, wherein the first enabling signal enables the microprocessor to generate first and second output signals in response to electronic signals received from the right foot pedal implement control sensor and the left foot pedal boom control sensor, and electronic signals received from the right hand stick implement control sensor and the left hand stick boom control sensor have no effect on the first and second output signals generated by the microprocessor.

In accordance with a twelfth preferred embodiment, the eleventh preferred embodiment is further modified so that the microprocessor uses electronic signals received from the right foot pedal implement control sensor to generate the second output signal and electronic signals received from the left foot pedal boom control sensor to generate the first output signal.

In accordance with a thirteenth preferred embodiment, the eleventh preferred embodiment is further modified so that the hand/foot controls selector switch is connected to send a second enabling signal to the microprocessor, wherein the second enabling signal enables the microprocessor to generate first and second output signals in response to electronic signals received from the right hand stick implement control sensor and the left hand stick boom control sensor, and electronic signals received from the right foot pedal implement control sensor and the left foot pedal boom control sensor have no effect on the first and second output signals generated by the microprocessor.

In accordance with a fourteenth preferred embodiment, the eighth preferred embodiment is further modified to include a status display disposed within an operator's cab, the cab being integral to the machine, wherein the status display includes a first light source connected to receive third output signals from the microprocessor, and the microprocessor sends the third output signals to control flashing of a light source until the microprocessor generates the first enabling signal.

In accordance with a fifteenth preferred embodiment, the eleventh preferred embodiment is further modified to include a status display disposed within an operator's cab, the cab being integral to the machine, wherein the status display includes a first light source connected to receive third output signals from the microprocessor, and the microprocessor sends the third output signals to control flashing of a light source until the microprocessor generates the first enabling signal.

In accordance with a sixteenth preferred embodiment, the second preferred embodiment is further modified to include a status display disposed within an operator's cab, the cab being integral to the machine, wherein the status display includes a first light source connected to receive third output signals from the microprocessor, and the microprocessor sends the third output signals to control flashing of a light source until the microprocessor receives the first activation signal from the safety switch.

In accordance with a seventeenth preferred embodiment, the first preferred embodiment is further modified to include an implement angle position sensor disposed to sense an angular position of the implement assembly relative to the machine and generate an implement angle position input signal, wherein the microprocessor is connected to receive the implement angle position input signal from the implement angle position sensor; and optionally, a tilt sensor disposed on the machine to sense a position of the machine relative to the horizon and generate a tilt input signal, wherein the microprocessor is connected to receive the tilt input signal from the tilt sensor, and wherein the microprocessor generates at least one of the first output signal and the second output signal in response to receiving the boom position input signal, the implement angle position input signal, and optionally the tilt input signal.

In accordance with an eighteenth preferred embodiment, the seventeenth preferred embodiment is further modified so that the microprocessor is programmed to perform an implement self-leveling function operable in three modes in response to receiving the boom position input signal, the implement angle position input signal, and optionally the tilt input signal, wherein the first mode is a null mode, the second mode is a return-to-dig mode, and the third mode is a horizon referencing mode, and the electronic control system further includes an implement leveler mode selection switch connected to send a mode selection signal to the microprocessor, wherein the microprocessor selectively operates in one of the null mode, the return-to-dig mode, and the horizon referencing mode in response to receiving the mode selection input signal from the implement leveler mode selection switch.

Further objects, features and advantages of the present invention will become apparent from the Detailed Description of Preferred Embodiments, which follows, when considered together with the attached drawings.

DETAILED DESCRIPTION OF THE PREFERRED EMBODIMENTS

Figure 1:
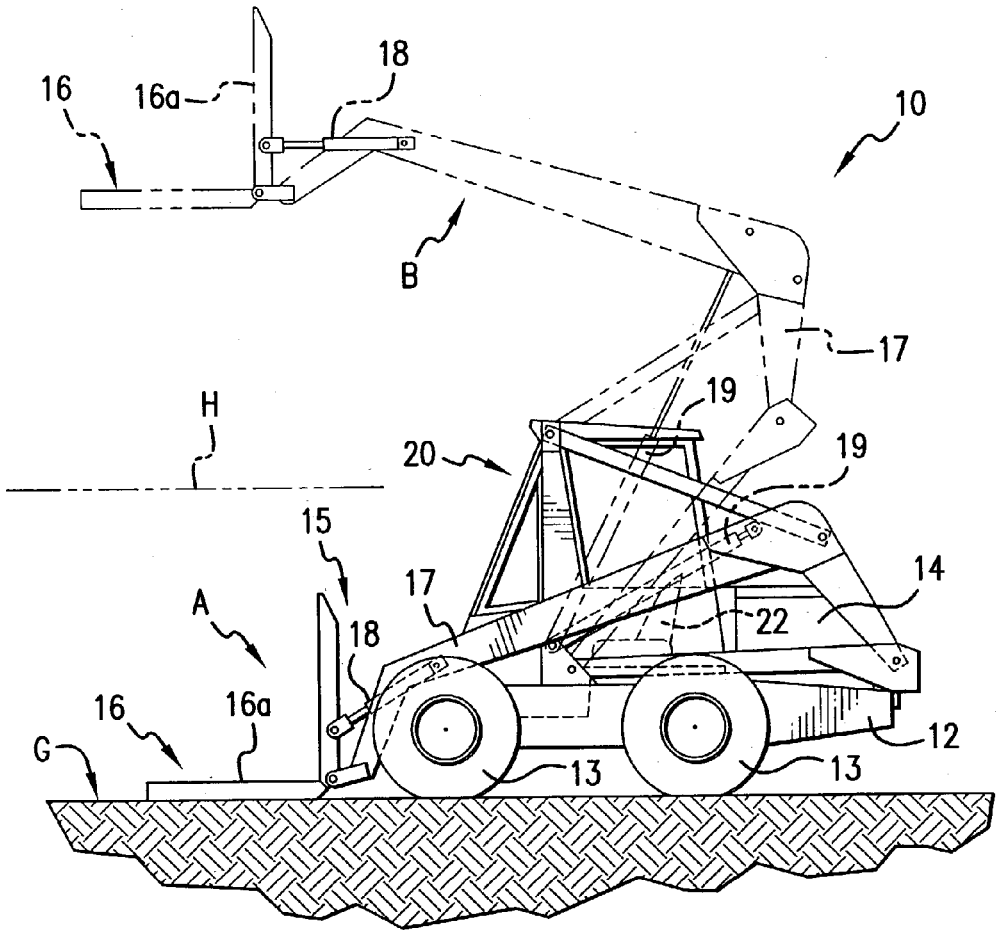
FIG. 1 is a schematic side perspective view of a work vehicle in accordance with the present invention with the hydraulically activated movement of the boom assembly being shown in phantom.

FIG. 1 shows a compact work vehicle 10, such as a skid steer loader or other like work vehicle, that includes a cab compartment 20 on the vehicle. Typically, work vehicle 10 includes a body 12 that is mounted on four wheels 13 (only two shown) suitably connected to be rotated by a transmission. The transmission is powered by an engine disposed in engine housing 14, located on the body 12. One skilled in the art would realize that the work vehicle 10 could be a tracked vehicle, a vehicle mounted on rails, or could be a machine mounted to a stationary frame without departing from the scope of the present invention.

Figure 4:
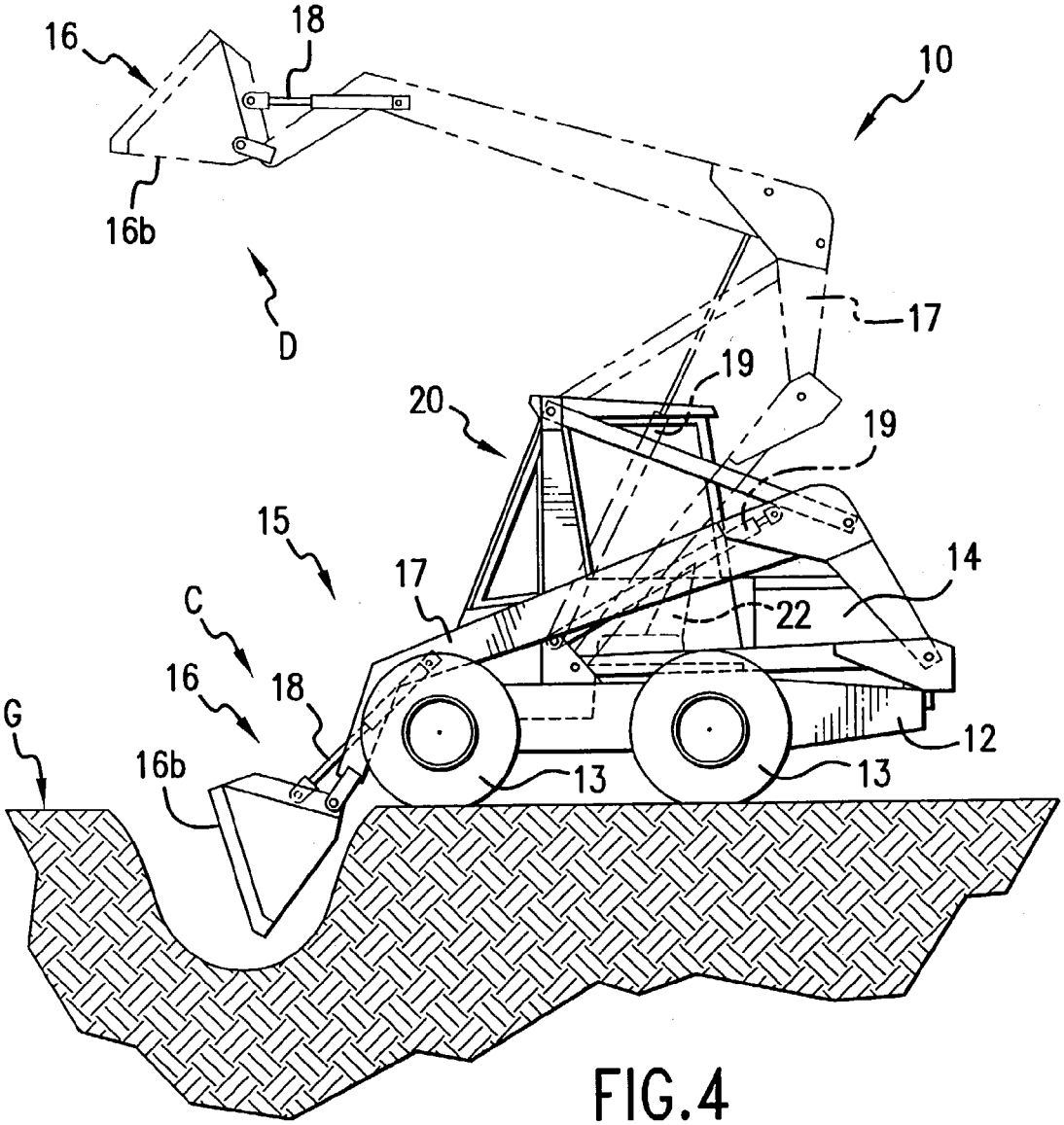
FIG. 4 is a schematic side perspective view of a work vehicle in accordance with the present invention illustrating movement of the boom assembly and loader bucket implement in the "return-to-dig" mode.

Work vehicle 10 includes a boom arm assembly 17 that is pivotally connected to the body 12 at one end, and that is pivotally connected at its opposite end to a work implement 16, such as a loader bucket 16*b*, pallet forks attachment 16*a*, or other useful tool. As shown in FIG. 1, boom arm assembly 17 can be raised and lowered between a lower position A and an upper position B (shown in phantom) through a range of motion using hydraulic power provided by a pair of hydraulic boom cylinders 19 (only one shown) of a hydraulic circuit (not shown) so that the implement 16 can be used to perform its intended function. The hydraulic circuit also powers one or more hydraulic implement cylinders 18 (only one shown) for moving and/or activating the implement 16. In the case where the work vehicle 10 is a skid steer loader, the implement 16 is, for example, a loader bucket 16*b* and there is a pair of bucket cylinders (only one cylinder shown) for moving and/or activating the loader bucket as illustrated in FIG. 4.

Figure 2:
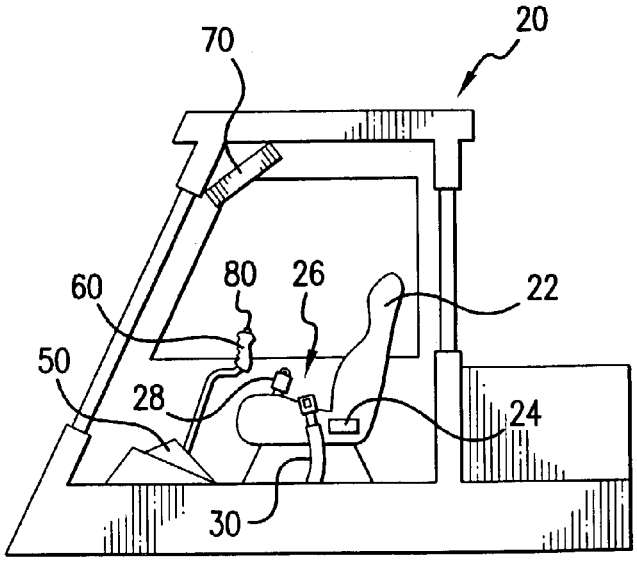
FIG. 2 is a cross sectional, cut away side view of the cab of the work vehicle shown in FIG. 1.

As shown in FIG. 2, inside of cab compartment 20, there is an operator's seat 22 upon which an operator sits while operating the work vehicle 10. Seat 22 is equipped with a seat pressure sensor or seat switch 24, such as described in U.S. Pat. Nos. 4,856,612 and 4,871,044, both of which are incorporated herein by reference for all they disclose. When seat 22 is empty, the seat switch 24 is open and when an operator sits in the seat 22, then the seat switch 24 is pressed into a closed state. Seat 22 is also equipped with a restraint seat belt switch 26 that includes a male end 28 that matingly secures to female end 30. When male end 28 and female end 30 are matingly secured together, then seat belt switch 26 is in the closed state. When male end 28 and female end 30 are not secured together, then scat belt switch 26 is in the open state.

Cab compartment 20 also includes a display, such as, for example, a Total Control System display ("TCS display") 70 for displaying various light indicators, LEDs, gauges and the like, to inform the operator of the status of the various monitored systems carried by the work vehicle 10. Cab compartment 20 also has a pair of foot control pedals 50 (only one pedal shown) and a pair of hand grip controls 60 (only one grip shown) for operating the boom arm assembly 17 and the implement 16.

Figure 3:
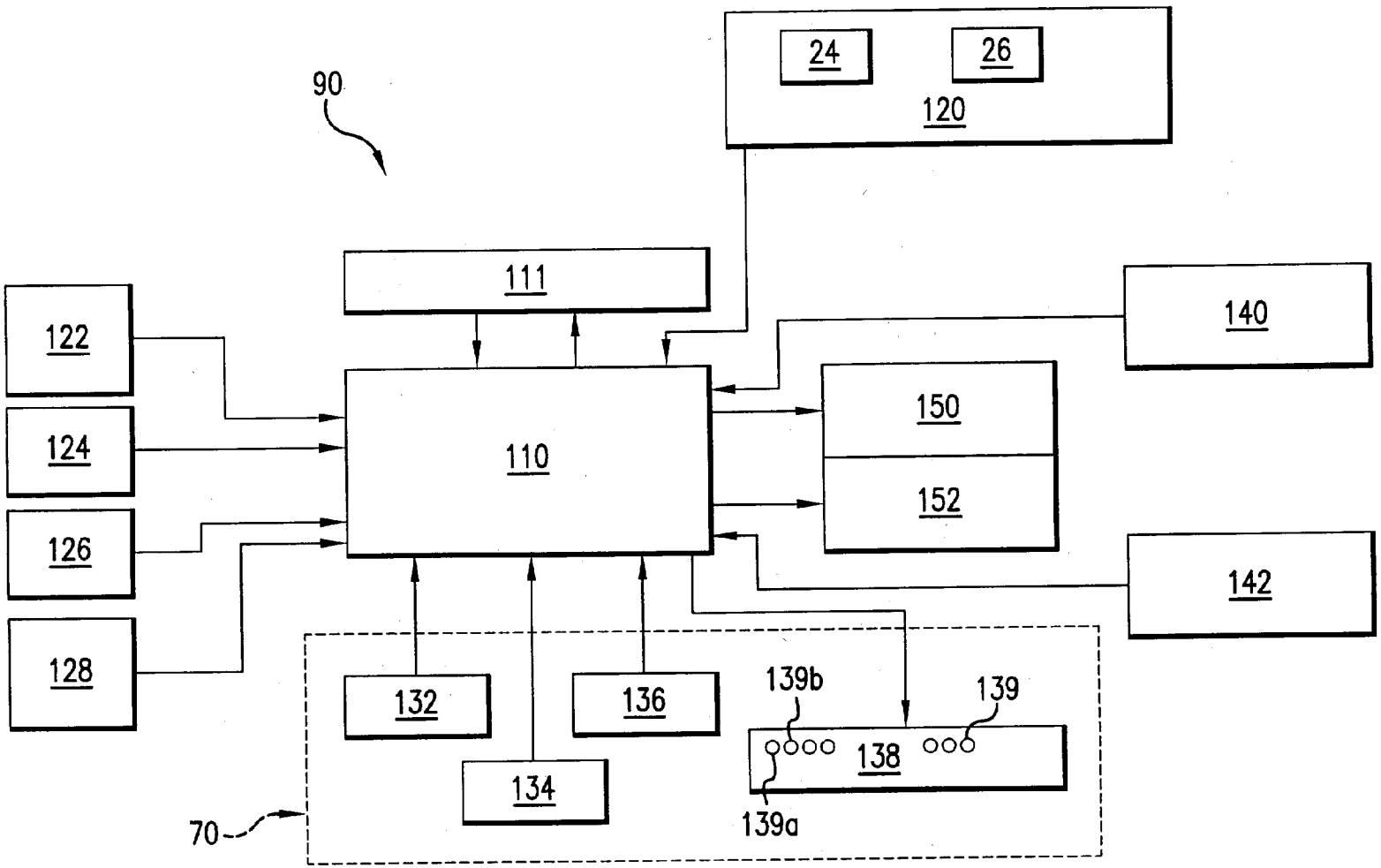
FIG. 3 is a schematic drawing of the electronic control system for a work vehicle having a boom assembly and an implement assembly connected to the boom assembly in accordance with the present invention.

FIG. 3 illustrates electrical connections between the various components of the electronic control system 90 in accordance with the present invention. Electronic control system 90 is carried by the work vehicle 10 and includes an on board controlling microprocessor (also referred to as the "controller") 110 connected to exchange data with a memory storage device 111. Preferably, memory storage device 111 is a non-volatile memory that stores the neutral positions of the foot control pedals 50 and the hand grip controls 60, and other data as described below. Although controller 110 and memory storage device 111 are preferably separate structures, controller 110 can be constructed to incorporate the memory storage device without departing from the scope of the invention.

Controller 110 is connected to receive electronic signal inputs from the following devices: operator "seat belt switch and seat switch" circuit 120, right hand stick implement control and position sensor 122, left hand stick boom control and position sensor 124, right foot pedal implement control and position sensor 126, left foot pedal boom control and position sensor 128, hand/foot controls selector switch 132, vehicle tilt sensor 134, implement leveler mode selection switch 136, boom position sensor 140, and implement angle position sensor 142. Although many different types of controllers are suitable for use as the controller 110 in system 90 of the present invention, microcontroller C167CR manufactured by Infineon Technologies AG (Germany) is particularly well suited for use in the present system environment.

The operator "seat belt switch and seat switch" circuit 120 is an electronic circuit that generates an enabling signal when seat belt switch 26 and seat switch 24 are in the closed state (i.e., an operator is sitting in seat 22 and the male end 28 of seat belt switch 26 is secured to the female end 30). Controller 110 is not enabled to produce control output signals until the seat belt switch and seat switch circuit 120 sends an enabling electronic signal to the controller. Seat belt switch 26 and seat switch 24 are incorporated into the "seat belt switch and seat switch" circuit 120 as indicated in FIG. 3. One such circuit suitable for use as the seat belt switch and seat switch circuit 120 is disclosed in U.S. Pat. No. 4,871,044 to Strosser et al., which is incorporated herein by reference for all it contains.

The right hand stick implement control and position sensor 122 is an electronic sensor that sends signals to controller 110 reporting the position of the right hand grip control 60. The position of the right hand grip control 60 is sensed by sensor 122 that generates an output signal sent to controller 110. Controller 110 processes the signals provided by sensor 122 and uses the information to operate electro-hydraulic implement cylinder valve 152, thereby controlling the position of implement 16 relative to boom assembly 17 as described below.

The left hand stick boom control and position sensor 124 is an electronic sensor that sends signals to controller 110 reporting the position of the left hand grip control 60. The position of the left hand grip control 60 is sensed by sensor 124 that generates an output signal sent to controller 110. Controller 110 processes the signals provided by sensor 124 and uses the information to operate electro-hydraulic boom cylinder valve 150, thereby controlling the position of boom assembly 17 relative to the work vehicle 10 as described below.

The right foot pedal implement control and position sensor 126 is an electronic sensor that sends signals to controller 110 reporting the position of the right foot control pedal 50. The position of the right foot control pedal 50 is sensed by sensor 126 that generates an output signal sent to controller 110. Controller 110 processes the signals provided by sensor 126 and uses the information to operate electro-hydraulic implement cylinder valve 152, thereby controlling the position of implement 16 relative to boom assembly 17 as described below.

The left foot pedal boom control and position sensor 128 is an electronic sensor that sends signals to controller 110 reporting the position of the left foot control pedal 50. The position of the left foot control pedal 50 is sensed by sensor 128 that generates an output signal sent to controller 110. Controller 110 processes the signals provided by sensor 128 and uses the information to operate electro-hydraulic boom cylinder valve 150, thereby controlling the position of boom assembly 17 relative to the work vehicle 10 as described below.

Preferably, the control and position sensors 122, 124, 126 and 128 generate analog output signals ranging from +0.5 to +4.5 V.

The hand/foot controls selector switch 132 is an electronic switch that operates to send input signals to controller 110, and controller 110 uses this input signal to enable either the hand grip controls 60 or the foot control pedals 50. Thus, in a first state, switch 132 has enabled or activated system 90 to use the hand controls 60, and disables or deactivates the foot control pedals 50. With switch 132 in the first state, only the right and left hand controls 60 can be used to effect operation of the electro-hydraulic valves 150 and 152 of the boom cylinders 19 and the implement cylinders 18, respectively. In a second state, switch 132 has enabled or activated the foot pedals 50, and disables or deactivates the hand controls 60. With switch 132 in the second state, only the right and left foot pedals 50 can be used to effect operation of the electro-hydraulic valves 150 and 152 of the boom cylinders 19 and the implement cylinders 18, respectively.

Preferably, switch 132 is constructed as a pressure sensing switch that sends a generic input signal to controller 110. In addition, controller 110 operates functionally to provide system 90 with a third state, wherein neither the hand controls 60 nor the foot pedals 50 are enabled, with or without an input signal from sensor 132. In other words, when switch 132 is used to select the third state, the boom assembly 17 and the implement 16 are not operable. This condition is desirable when accidental operation of the boom assembly 17 and implement 16 is to be avoided, such as when driving the work vehicle 10 a relatively long distance from one work site to another work site. However, when the work vehicle 10 is initially started up, controller 110 is programmed to initiate system 90 in the third state (i.e., neither hand controls 60 nor foot pedal controls 50 are enabled).

As mentioned, controller 110 is pre-programmed so that upon start-up of the work vehicle 10, the system 90 is in the third state. In other words, at start-up neither the hand controls 60, nor the foot pedals 50, are enabled until switch 132 is pressed or operated. When switch 132 is first operated after start-up, the signal sent to controller 110 is used to enable either the hand controls 60 or the pedal controls 50, depending upon which set of controls was last enabled. In other words, controller 110 uses information stored in memory 111 that identifies which set of controls, either 60 or 50, were last enabled, and uses this information to preferentially enable that set of controls after start-up when switch 132 is first activated. Thus, whenever switch 132 is operated, the controller 110 sends output signals to memory storage device 111 so that the system 90 can recall the last enabled state in operation, either the first or second state, prior to shutting down the system when the work vehicle 10 is turned off.

Vehicle tilt sensor 134 is an electronic sensing circuit that provides signal output to controller 110 that indicates the relative orientation of the work vehicle 10 with respect to the Earth's horizon. In other words, sensor 134 senses the position of the work vehicle 10 relative to the horizontal plane of the Earth's horizon and inputs this information into controller 110 so that the controller can use the information to make automatic adjustments in the operation of the electro-hydraulic valves 150 and 152 effecting movement of the boom assembly 17 and the implement 16, respectively.

Acceptable devices for use as the vehicle tilt sensor 134 include a linear mercury switch, or a capacitive fluid tilt sensor. However, it has been determined that Micro Electro Mechanical Systems ("MEMS"), which utilize micromachined angular rate sensor technology, provide excellent gyroscopic inertial sensors that are superior for use as the vehicle tilt sensor 134. Micromachined angular rate sensors, such as the BEI Gyrochip™ II (Part Nos. QRS14-0XXXX 102 and QRS14-0XXXX 103, Systron Donner Inertial Division, Concord, Calif., www.systron.com), measure angular rotation rates using a solid-state monolithic quartz sensing element. These micromachined angular rate sensors are reliable and durable, having an operating temperature of −40° C. to +85° C. and tolerate shock of 200 g.

The boom position sensor 140 is an electronic sensor that is carried by the boom assembly 17 and provides an input signal to the controller 110 for determining the height of the boom assembly relative to the work vehicle 10.

Optionally, system 90 can be provided with an implement angle position sensor 142, which is especially useful when the implement 16 is a londer bucket. The implement angle position sensor 142 is an electronic sensor that is carried by the boom assembly 17 and that provides an input signal to the controller 110 for determining the angular position of the implement 16 relative to the work vehicle 10.

Controller 110 is pre-programmed with an automatic implement self-leveling feature, which is most useful when implement 16 is a loader bucket 16*b* or a pallet forks lift attachment 16*a*. The automatic implement self-leveling feature is a programmed function of controller 110, wherein the controller operates to receive input from vehicle tilt sensor 134, boom position sensor 140, and optionally implement angle position sensor 142, and uses the inputted signals to generate output signals to electro-hydraulic valve 152 that effects operation of implement cylinders 18 and movement of the implement 16 relative to the boom assembly 17. In this manner, controller 110 can automatically control the relative orientation of the implement 16 relative to the boom assembly 17. The controller 110 is programmed to operate in this automatic self-leveling feature in three modes: (a) the null mode, (b) the "return-to-dig" mode, and (c) the "horizon referencing" mode. The implement leveler mode selection switch 136 is an electronic switch that operates to select either one of the three modes. In addition, system 90 can be constructed so signal information used to select and activate the desired self-leveling mode can be stored by the memory storage device 111. In this manner, system 90 would recall the last implement self-leveling mode in operation upon shutdown of the work vehicle 10 so that the work vehicle begins in this mode upon start-up of the work vehicle; however, in a preferred embodiment of the invention system 90 defaults to the null mode upon start-up of the work vehicle.

The three automatic self-leveling modes will now be described. The null mode is the mode wherein the automatic self-leveling feature is disabled. In other words, when the controller 110 is operating in the null mode there is no self-leveling feature in effect and implement 16 will be positioned relative to the boom assembly 17 as directed by the positions of the enabled left foot pedal 50 or enabled left hand control 60. The null mode may be activated using switch 136, and/or it may be the default mode of system 90 upon activation of the work vehicle 10.

In the return-to-dig mode, as illustrated in FIG. 4, controller 110 operates to return the orientation and position of implement 16 and boom assembly 17 to a fixed, memorized orientation and position relative to the work vehicle 10. In other words, at the moment the return-to-dig mode is activated, controller 110 receives signals from boom position sensor 140 and implement angle position sensor 142 and stores this information in memory storage device 111, thereby memorizing the position and orientation of the boom assembly 17 and the implement 16. This memorized position and orientation is referred to the "return-to-dig" position, although it need not be a position and orientation used for digging. Subsequently, the operator is free to move implement 16 and boom assembly 17 using either the enabled hand controls 60 or the enabled foot pedal controls 50, depending upon which pair of controls have been selectively enabled by the operator as described above. In the return-to-dig mode, the operator can return implement 16 and the boom assembly 17 to the memorized "return-to-dig" position by pressing a "return-to-dig" switch button 80 disposed on one of the hand controls 50. This button would be connected to operate a switch that is connected to send a signal to controller 110 informing the controller to operate electro-hydraulic valves 150, 152 to return the implement 16 and boom assembly 17 back to the return-to-dig position based on the information stored in the memory storage device 111.

As an illustrative example, as shown in FIG. 4, the operator can activate the return-to-dig mode using switch 136 when the implement 16 and boom assembly 17 are in a first position, such as the position and orientation represented at C. The operator can subsequently move the implement 16 and boom assembly 17 using either enabled hand controls 60 or enabled foot pedal controls 50. At any time while implement 16 and boom assembly 17 are in a second position, such as the exemplary position and orientation represented at D, the operator can press the "return-to-dig" switch button 80, thereby activating the controller 110 to return the implement and the boom assembly from position D back to the selected return-to-dig position C. One of ordinary skill in the art would appreciate that FIG. 4 is merely exemplary, and that the return-to-dig position represented by C could be any position within the range of motion attainable by the controlled movement of implement 16 and boom assembly 17. Furthermore, the second position D could be any other attainable position within the range of motion of the implement and the boom assembly. The benefit of having the return-to-dig mode is that, while engaged in digging or any other repetitive movement of the implement and boom assembly, the operator can, at the touch of a button, return the implement and boom assembly to a desired first position from any other second position.

Operation of switch 136 places system 90 into the return-to-dig mode. Although FIG. 4 illustrates implement 16 as a loader bucket 16*b*, one skilled in the art would realize that the return-to-dig mode can be used with other implements, such as a snow blade attachment, push broom attachment, and the like, attached to the boom assembly 17 of the work vehicle 10. System 90 is also operable in the horizon referencing mode by switching modes using switch 136.

In the horizon referencing mode, as illustrated in FIG. 1, controller 110 operates to maintain the orientation of implement 16 parallel with the horizon H regardless of the orientation and position of the boom assembly 17. In other words, at the moment that the horizon referencing mode is activated using switch 136, controller 110 receives signals from boom position sensor 140, optionally implement angle position sensor 142, and vehicle tilt sensor 134, and uses this information to operate electro-hydraulic implement cylinder valve 152 to maintain the orientation of implement 16 parallel with the horizon H. In FIG. 1, implement 16 is shown oriented horizontal with the ground G as the boom assembly 17 moves between positions A and B, and vice versa. One skilled in the art would realize that when the ground G is not flat, tilt sensor 134 provides signals to controller 110 so that the controller can take into account the position of the work vehicle 10 relative to the horizon H in order to maintain implement 16 parallel with the horizon. Subsequently, the operator is free to move the boom assembly 17 using either the enabled hand controls 60 or the enabled foot pedal controls 50, and the controller 110 will maintain the orientation of implement 16 parallel with the horizon H throughout the range of motion of the boom assembly.

Thus, implement 16 is maintained parallel with the horizon H in response to signal input from tilt sensor 134, which may or may not mean that implement 16 is maintained parallel to ground G. In the case where ground G and horizon H are parallel, as shown in FIG. 1, implement 16 is maintained parallel to both the horizon and the ground. On the other hand, when the ground G is not parallel with horizon H, such as occurs when the work vehicle 10 is on the slope of a depression or a hill, system 90, operating in the horizon referencing mode, would keep implement 16 parallel to horizon H, not ground G.

One skilled in the art would also realize that system 90 could be practiced without vehicle tilt sensor 134; however, in this case the horizon referencing mode would maintain the orientation of implement 16 parallel to the frame of body 12 and not necessarily to the horizon. Clearly, it is preferred to practice system 90 with tilt sensor 134 because there are operations wherein it is desirable to maintain the implement 16 parallel to the horizon. One such operation is when implement 16 is a pallet forks lift attachment 16*a* and it is desirable to keep the platform held by the forks lift level to the horizon to prevent spillage of materials off of the platform. However, one skilled in the art would realize that the horizon referencing mode could be selected when work vehicle 10 carries some other implement such as a loader bucket 16*b*.

Controller 110 is connected to send electronic output signals for control purposes, or for display purposes, depending upon the nature of the device receiving the output signals from the controller. Specifically, controller 110 is connected to send electronic control signals to electro-hydraulic valves 150, 152. Electronic control signals sent to boom cylinder valve 150 effect proportional control of hydraulic flow according to displacement of the left side operator controls, (i.e., either left foot control 50 or left hand control 60), so the electro-hydraulic valve 150 activates a respective boom cylinder or cylinders 19, thereby collectively moving the boom assembly 17 between different positions such as positions A and B as shown in FIG. 1. Controller 110 also sends electronic control signals to implement cylinder valve 152 to effect proportional control of hydraulic flow according to displacement of the right side operator controls, (i.e., either right foot control 50 or right hand control 60), so the electro-hydraulic valve 152 activates a respective implement cylinder or cylinders 18, thereby collectively moving or rotating implement 16 relative to the boom assembly 17.

Controller 110 is also connected to send electronic output display signals for activating indicators 139 on a status display 138. Preferably, indicators 139 are LEDs or light bulbs that light up when activated by output signals from controller 110; however, indicators 139 can also be electronic gauges and the like for displaying information useful to an operator of the work vehicle 10.

Status display 138 is disposed on a portion of the TCS display 70 as shown in FIG. 3. TCS display 70 also includes the hand/foot controls selector switch 132, the vehicle tilt sensor 134, and the implement leveler mode switch 136. As shown in FIG. 2, the TCS display 70 is positioned in cab 20 so as to be readily observable by the vehicle operator. Preferably, the TCS display 70 is located in the upper front portion of cab 20, although other locations in the cab are suitable as long as the TCS display 70 is readily observable by the vehicle operator.

Since the components of electronic control system 90 for controlling movement of boom assembly 17 and implement 16 have been described in full detail, it is easy to understand the theory of operation for the control system 90 as will be described. Upon power-up of work vehicle 10, controller 110 prevents operator control over the boom assembly 17 and the implement 16 until the following enabling conditions are met: (a) the operator is seated in seat 22, thereby closing seat switch 24; (b) restraint belt switch 26 is in the closed state (i.e., male end 28 is secured to female end 30); and (c) the hand/foot controls selector switch 132 is pushed. When conditions (a), (b) and (c) are met, the controller 110 recalls from non-volatile memory storage device 111 the last enabled operator control state of system 90, being either the first state wherein the hand controls 60 are enabled, or the second state wherein the foot controls 50 are enabled. Furthermore, upon power-up, controller 110 sends output signals to status display 138 so that a red LED 139*a* will flash until the operator is seated and has closed seat belt switch 26 and seat switch 24. In addition, until the operator pushes the hand/foot controls selector switch 132, a yellow LED 139*b* flashes on status display 138.

Analog signals generated by hand control sensors 122, 124 and foot control sensors 126, 128 are proportional to the displacement of the hand controls 60 and foot controls 50, respectively, from a neutral position stored in the memory storage device 111. Based upon the magnitude of displacement of each control 50, 60 from the neutral position, controller 110 routes hydraulic fluid flow in a proportional manner using electro-hydraulic valves 150, 152 to effect movement of boom assembly 17 and implement 16. What the operator in the cab perceives is that displacement of enabled controls 50 or 60 affects both the velocity of movement, and the position, of the boom assembly 17 and implement 16.

Other preferred programmed features of system 90 include that upon start-up the automatic self-leveling feature (also referred to as the "implement leveler mode") is defaulted to the null mode. In addition, controller 110 is programmed so that if the operator is out of the seat 22 for a time period exceeding a pre-determined time period, then the operator must re-sequence the "seat belt switch and seat switch" circuit 120 and re-push the hand/foot controls selector switch 132 in order to re-enable controller 110 to control hydraulic fluid flow through electro-hydraulic valves 150, 152.

Another preferred programmed feature of system 90 is that when the operator turns off the work vehicle 10 using an ignition key, or the like, and does not leave the seat 22 (i.e., seat switch 24 remains closed) and the seat belt remains fastened (i.e., restraint belt switch 26 remains closed), then controller 110 is programmed to automatically re-enable hydraulic fluid flow via valves 150 and 152 upon re-start of the vehicle 10 without the need for the operator to re-sequence the "seat belt switch and seat switch" circuit 120, and re-push the hand/foot controls selector switch 132.

Yet another preferred programmed feature of system 90 is that the hand/foot controls selector switch 132 can be operated to change the control option from hand to foot, and vice versa, while work vehicle 10 is powered up and operating.

While the present invention has been described with reference to certain preferred embodiments, one of ordinary skill in the art will recognize that additions, deletions, substitutions, modifications and improvements can be made while remaining within the spirit and scope of the present invention as defined by the appended claims.

What is claimed is:

1. An electronic control system for a machine having a boom assembly and an implement assembly connected to the boom assembly, the control system comprising:

a microprocessor having an input and generating first and second output signals;

a boom position sensor disposed on the boom assembly and connected to send a boom position input signal to the microprocessor, wherein the microprocessor is connected to receive the boom position input signal and generates at least one of the first output signal and the second output signal, thereby controlling a position of the implement assembly relative to the boom assembly;

a first electrohydraulic valve connected to receive the first output signal from the microprocessor, wherein the first electrohydraulic valve is connected to position the boom assembly in response to the first output signal;

a second electrohydraulic valve connected to receive the second output signal from the microprocessor, wherein the second electrohydraulic valve is connected to position the implement assembly in response to the second output signal;

a right hand stick implement control sensor disposed to sense a position of a right hand control;

a left hand stick boom control sensor disposed to sense a position of a left hand control;

a right foot pedal implement control sensor disposed to sense a position of a right foot pedal control;

a left foot pedal boom control sensor disposed to sense a position of a left foot pedal control, where each control sensor is connected to send electronic signals to the microprocessor; and a hand/foot controls selector switch connected to send a first enabling signal to the microprocessor, wherein the first enabling signal enables the microprocessor (a) to generate first and second output signals in response to electronic signals received from the right hand stick implement control sensor and the left hand stick boom control sensor, and (b) but not to generate first and second output signals in response to electronic signals received from the right foot pedal implement control sensor and the left foot pedal boom control sensor.

2. An electronic control system as recited in claim 1, further comprising:

a safety switch circuit connected to send a first activation signal to the microprocessor, wherein the microprocessor is unable to generate the first output signal and is unable to generate the second output signal until the microprocessor receives the first activation signal generated by the safety switch circuit.

3. An electronic control system as recited in claim 2, wherein the safety switch circuit is connected to a seat belt having male and female ends, and wherein the safety switch circuit sends the first activation signal when the male and female ends are secured together.

4. An electronic control system as recited in claim 2, wherein the safety switch circuit is connected to an operator's seat, and wherein the safety switch circuit sends the first activation signal when an operator is sitting in the operator's seat.

5. An electronic control system as recited in claim 2, wherein the safety switch circuit is connected to a sent belt having male and female ends, wherein the safety switch circuit is connected to an operator's seat, and wherein the safety switch circuit sends the first activation signal when the male and female ends of the seat belt are secured together and an operator is sitting in the operator's seat.

6. An electronic control system as recited in claim 1, wherein the implement assembly is selected from the group consisting of a pallet fork lift assembly and a loader bucket assembly.

7. An electronic control system as recited in claim 1, wherein the microprocessor generates the second output signal in response to electronic signals received from the right band stick implement control sensor and generates the first output signal in response to electronic signals received from the left hand stick boom control sensor.

8. An electronic control system as recited in claim 1, wherein the hand/foot controls selector switch is connected to send a second enabling signal to the microprocessor (a), wherein the second enabling signal enables the microprocessor to generate first and second output signals in response to electronic signals received from the right foot pedal implement control sensor and the left fool pedal boom control sensor, and (b) but not to generate first and second output signals in response to electronic signals received from the right hand stick implement control sensor and the left hand stick boom control sensor.

9. An electronic control system for a machine having a boom assembly and an implement assembly connected to the boom assembly, the control system comprising:

a microprocessor having an input and generating first and second output signals;

a boom position sensor disposed on the boom assembly and connected to send a boom position input signal to the microprocessor, wherein the microprocessor is connected to receive the boom position input signal and generates at least one of the first output signal and the second output signal, thereby controlling a position of the implement assembly relative to the boom assembly;

a first electrohydraulic valve connected to receive the first output signal from the microprocessor, wherein the first electrohydraulic valve is connected to position the boom assembly in response to the first output signal;

a second electrohydraulic valve connected to receive the second output signal from the microprocessor, wherein the second electrohydraulic valve is connected to position the implement assembly in response to the second output signal;

a right hand stick implement control sensor disposed to sense a position of a right hand control;

a left hand stick boom control sensor disposed to sense a position of a left hand control;

a right foot pedal implement control sensor disposed to sense a position of a right foot pedal control; and a hand/foot controls selector switch connected to send a first enabling signal to the microprocessor, wherein the first enabling signal enables the microprocessor (a) to generate first and second output signals in response to electronic signals received from the right foot pedal implement control sensor and the left foot pedal boom control sensor, and (b) but not to generate first and second output signals in response to electronic signals received from the right hand stick implement control sensor and the left hand stick boom control sensor.

10. An electronic control system as recited in claim 9, wherein the microprocessor generates the second output signal in response to electronic signals received from the right foot pedal implement control sensor and generates the first output signal in response to electronic signals received from the left foot pedal boom control sensor.

11. An electronic control system as recited in claim 9, wherein the hand/foot controls selector switch is connected to send a second enabling signal to the microprocessor, wherein the second enabling signal enables the microprocessor (a) to generate first and second output signals in response to electronic signals received from the right hand stick implement control sensor and the left hand stick boom control sensor, and (b) but not to generate first and second output signals in response to electronic signals received from the right foot pedal implement control sensor and the left foot pedal boom control sensor.

12. An electronic control system as recited in claim 1, further comprising:

a status display including a first light source connected to receive third output signals from the microprocessor, wherein the microprocessor sends the third output signals to control flashing of the light source until the microprocessor generates the first enabling signal.

13. An electronic control system as recited in claim 9, further comprising:

a status display including a first light source connected to receive third output signals from the microprocessor, wherein the microprocessor sends the third output signals to control flashing of the light source until the microprocessor generates the first enabling signal.

14. An electronic control system as recited in claim 2, further comprising:

a status display including a first light source connected to receive third output signals from the microprocessor, wherein the microprocessor sends the third output signals to control flashing of a light source until the microprocessor receives the first activation signal from the safety switch.

15. An electronic control system as recited in claim 1, further comprising:

an implement angle position sensor disposed to sense an angular position of the implement assembly relative to the machine and generate an implement angle position input signal, wherein the microprocessor is configured to receive the implement angle position input signal from the implement angle position sensor; and wherein the microprocessor generates at least one of the first output signal and the second output signal in response to receiving the boom position input signal and the implement angle position input signal.

16. An electronic control system as recited in claim 15, further comprising:

a tilt sensor disposed on the machine to sense a position of the machine relative to the horizon and generate a tilt input signal, wherein the microprocessor is connected to receive the tilt input signal from the tilt sensor, and wherein the microprocessor generates at least one of the first output signal and the second output signal in response to receiving the boom position input signal, the implement angle position input signal, and the tilt input signal.

17. An electronic control system as recited in claim 16, wherein the microprocessor is programmed to perform and implement self-leveling function operable in three modes in response to receiving the boom position input signal, the implement angle position input signal, and the tilt input signal, wherein the first mode is a null mode, the second mode is a return-to-dig mode, and the third mode is a horizon referencing mode, and the electronic control system further comprises:

an implement leveler mode selection switch connected to send a mode selection signal to the microprocessor, wherein the microprocessor selectively operates in one of the null mode, the return-to-dig mode, and the horizon referencing mode in response to receiving the mode selection input signal from the implement leveler mode select don switch.

* * * * *